US006290078B1

(12) United States Patent
Verchere

(10) Patent No.: US 6,290,078 B1
(45) Date of Patent: Sep. 18, 2001

(54) DEVICE FOR FOLDING A CRANE JIB WITH NESTING ELEMENTS

(75) Inventor: Jean-Paul Verchere, Les Bruyeres (FR)

(73) Assignee: Potain, Ecully (FR)

( * ) Notice: Subject to any disclaimer, the term of this patent is extended or adjusted under 35 U.S.C. 154(b) by 0 days.

(21) Appl. No.: 09/599,960

(22) Filed: Jun. 23, 2000

(30) Foreign Application Priority Data

Jul. 22, 1999 (FR) ..... 9909688

(51) Int. Cl.[7] ..... B66C 23/42
(52) U.S. Cl. ..... 212/300
(58) Field of Search ..... 212/297, 300, 212/238, 260, 261, 262

(56) References Cited

U.S. PATENT DOCUMENTS

| | | | | |
|---|---|---|---|---|
| 2,581,087 | * | 1/1952 | Eakin | 212/261 |
| 2,689,053 | * | 9/1954 | Olson | 212/261 |
| 2,901,125 | * | 8/1959 | Troche | 212/261 |
| 3,032,207 | * | 5/1962 | McIntyre | 212/238 |
| 3,426,916 | * | 2/1969 | Novotny | 212/238 |
| 3,819,059 | * | 6/1974 | Mantel | 212/238 |
| 3,944,081 | * | 3/1976 | Wellman | 212/297 |
| 4,150,754 | * | 4/1979 | Schmitt | 212/300 |
| 4,400,994 | * | 8/1983 | Skjaeveland | 74/520 |
| 4,775,287 | * | 10/1988 | Hering | 414/694 |

FOREIGN PATENT DOCUMENTS

| | | |
|---|---|---|
| 34 41 573 | 5/1986 | (DE) . |
| 93 16 113 U | 2/1995 | (DE) . |
| 2 546 496 | 11/1984 | (FR) . |
| 2 594 427 | 8/1987 | (FR) . |

* cited by examiner

*Primary Examiner*—Thomas J. Brahan
(74) *Attorney, Agent, or Firm*—Oliff & Berridge, PLC

(57) ABSTRACT

This device for independently controlled motorized unfolding/folding, is applicable to a crane jib, two consecutive elements of which are articulated to one another about a horizontal axle located approximately mid-way up the jib, and which have respective cross sections which allow them to nest, in the folded position. The motorization system comprises a double-acting ram and a set of link rods. The ram is articulated to the rear jib element in the region of the upper members and to two link rods, one straight and the other cranked, which form the link rod system. One link rod is articulated to the rear part of the front jib element and the other link rod is articulated to the front part of the rear jib element in the region of the lower parts of these elements.

8 Claims, 4 Drawing Sheets

DEVICE FOR FOLDING A CRANE JIB WITH NESTING ELEMENTS

BACKGROUND OF THE INVENTION

The present invention relates to a device for the independently controlled motorized unfolding/folding of a crane jib made up of elements joined together by articulation, with two consecutive jib elements which can nest one inside the other when the jib is in the folded position.

DESCRIPTION OF THE PRIOR ART

German patent application No. 3 441 573 already discloses a tower crane, the jib of which is made up of two elements, known respectively as the jib root and the jib tip, which are articulated together about a horizontal axle located approximately mid-way up the jib. The jib root has a cross section of triangular shape, and the jib tip has a cross section of U-shape so that folding the jib tip onto the jib root about the aforementioned horizontal axle may be continued until the two jib elements are nested one inside the other.

This known folding device also comprises a link rod linking the upper members of the two jib elements, said link rod being articulated to the front end of the upper member of the jib root, and sliding in lateral guides in the shape of arcs of a circle provided at the rear of the jib tip.

In the aforementioned German patent application No. 3 441 573, the unfolding/folding of the jib is motorized by means of a sheathed cable, controlled by the articulation between the jib root and the top of the mast of the crane. What this means is that the dynamics of the unfolding/folding of the jib elements are dictated by the movement of the jib root.

In consequence, the bulk of the jib while it is being assembled is always great, and does not allow the avoidance of any obstacle that might be present. In addition, it is impossible to unfold/fold the jib tip when the crane is working, in an attempt to avoid an obstacle or in order to distribute a load using a short-jib configuration.

French patent application No. 2 546 496 describes another tower crane with a jib made up of two elements articulated together and which can be nested when in the folded position. The two jib elements are articulated together about a horizontal axle located mid-way up the jib, the jib root in this instance having a U-shaped cross section, while the jib tip has a cross section of triangular shape. The unfolding/folding of the jib is motorized by means of a cable associated with a circular-arc-shaped lever arm, which is itself motorized by the articulation of the jib root to the top of the mast of the crane.

This motorization device makes it possible to place the jib in a "swan-neck" position when continuing to raise this job. However, it retains the same disadvantages as those present in the previous document, because the dynamics of unfolding/folding the jib elements are still dictated by the movement of the jib root.

SUMMARY OF THE INVENTION

The present invention sets out to overcome these drawbacks by providing a folding/unfolding device that makes it possible, while assembling the crane or while the crane is working, to avoid obstacles such as existing buildings, trees, power lines, etc., while at the same time making it possible to increase the load-carrying capacity by folding the jib tip.

To this end, the subject of the invention is essentially a device for the motorized unfolding/folding of a crane jib made up of elements joined together by articulation, with two consecutive jib elements which can nest one inside the other when the jib is in the folded position, these two elements having respective cross sections which allow them to nest, and being articulated together about a horizontal axle located approximately mid-way up the jib, the front jib element having, in its rear part, lateral guides in the shape of arcs of a circle housing a transverse horizontal axle connected to the rear jib element, the unfolding/folding device comprising, to motorize it, on the one hand, a double-acting ram located in the vertical mid-plane of the jib and articulated by a first end, about a horizontal axle, to the rear jib element in the region of the upper member or members of this element and, on the other hand, a set of link rods made up of a straight link rod articulated, on the one hand, to the second end of the ram and, on the other hand, to the rear part of the front jib element in the lower part of this element and of a cranked link rod articulated, on the one hand, to the second end of the ream and, on the other hand, to the front part of the rear jib element in the lower part of this element, the cranked link rod leaving space, at its cranked region, for the passage of the horizontal axle housed in the circular-arc-shaped lateral guides.

respective ends of these links rods, opposite those articulated to the ram, are preferably articulated to respective clevis mounts, one fixed to the lower part of the front jib element and the other fixed to the lower part of the rear jib element.

This then yields a device for unfolding/folding two nesting consecutive jib elements, such as a jib root and a jib tip, in the case of a jib made of two articulated elements, which is a motorized device controlled independently by a special-purpose ram. Deploying the ram rod allows the jib elements to be unfolded into an aligned relative position, and retracting the ram rod allows the jib elements to be folded until they are completely nested, it also being possible to attain any intermediate relative position. Thus, the position of the jib tip is no longer dictated by that of the jib root, and the jib tip may, at any moment, be brought into a desired position in order to avoid an obstacle. What is more, the jib tip may occasionally be folded to allow the crane to operate with a short jib and thus increase the load-carrying capacity of the crane. The link rod system is designed to allow the front jib element to rotate through 180° with respect to the rear jib element.

According to one embodiment of the device, the rear part of the front jib element comprises two vertical lateral plates, in each of which a guide and buffer slot in the form of an arc of a circle is formed, each slot having, passing through it, one end of the transverse horizontal axle connected to the rear jib element, and each lateral plate having, passing through it, the axle that articulates the front jib element with respect to the rear jib element and which is located approximately mid-way up the jib.

The articulation slots thus provided on the lateral faces of the front jib element, such as jib tip, fulfill the following functions:

- they act as upper stops which, in collaboration with the horizontal axle passing through these slots, provide a connection between the upper members of the two jib elements, such as the jib root and the jib tip when the jib is aligned;
- they act as lower stops for the same axle, when the jib is fully folded, the two jib elements then being nested one inside the other;
- they provide this axle with safe guidance during the operations of unfolding and folding the jib elements.

Advantageously, the axle that articulates the front jib element with respect to the rear jib element and which is located approximately mid-way up the jib, has functional play, so as to free this axle of any load, to make the system connecting the two jib elements an isostatic system when this jib is aligned.

According to one embodiment of the device of the invention, the front ends of the members of the rear jib element are connected by a transverse stiffening sleeve through which the aforementioned transverse horizontal axle passes.

To provide the connection at the lower members of the jib elements, it is contrived that, according to an additional feature, the lower members of the rear jib element comprise, at their front end, support and guiding means for the rear ends of the lower members of the front jib element; these means preferably comprise, at the front end of each lower member of the rear jib element, a horizontal support and a lower guide afforded by a support plate, and a lateral guide afforded by a ramped support plate, a combination such as this making it possible to take up all the loads and accurately align the lower members of the two jib elements in such a way as to form a continuous runway for the crab which can travel along the jib.

BRIEF DESCRIPTION OF THE DRAWINGS

In any event, the invention will be better understood from the description which follows, with reference to the appended diagrammatic drawing which, by way of example, depicts one embodiment of this device for folding a crane jib with nesting elements.

DESCRIPTION OF THE PREFERRED EMBODIMENT

Figure 1:
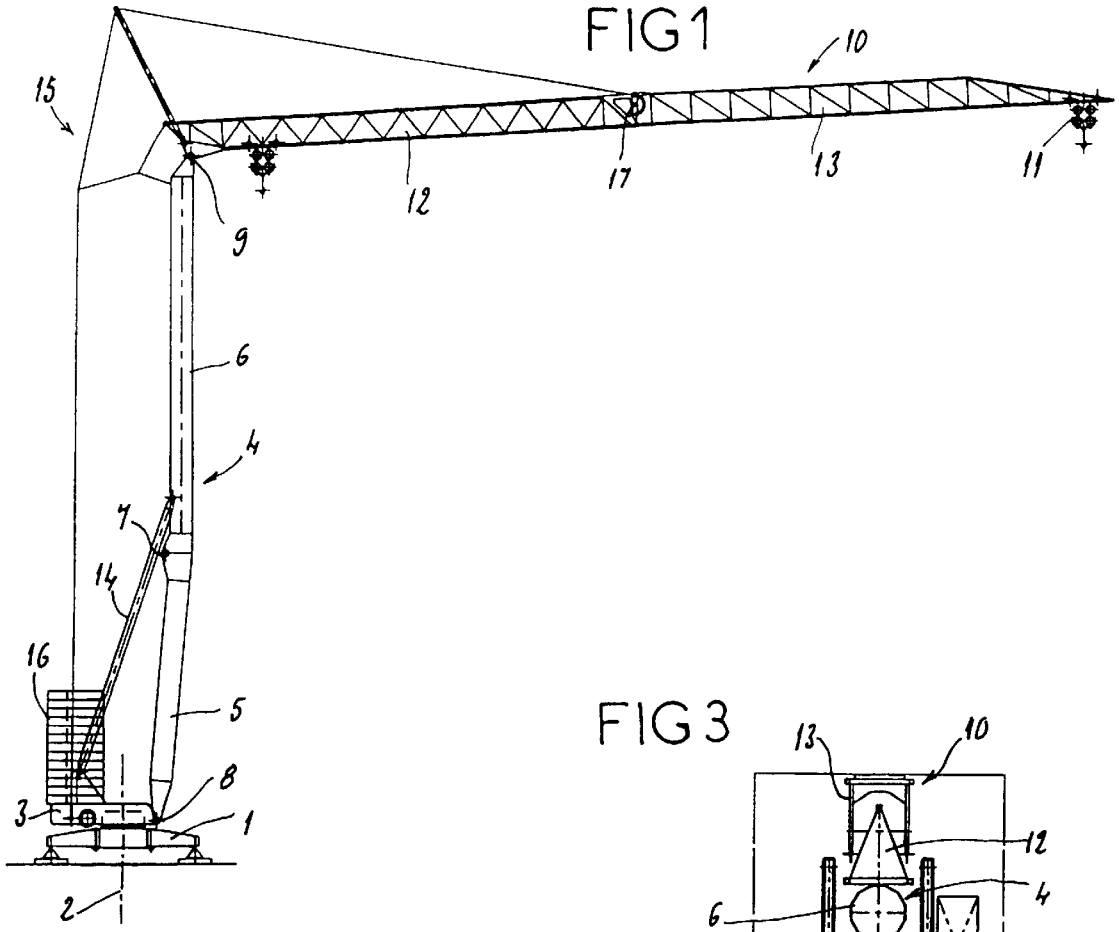
FIG. 1 is a side view, in the work position, of a crane with a jib equipped with a folding device according to the present invention.
Figure 3:
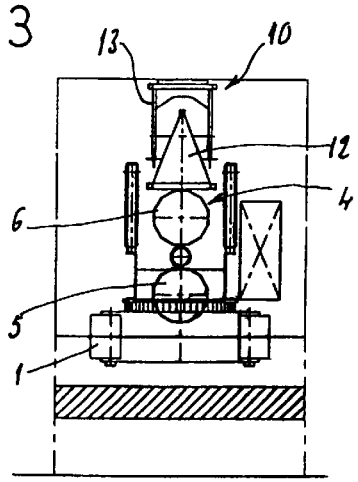
FIG. 3 is an end-on view of the folded crane.
Figure 2:
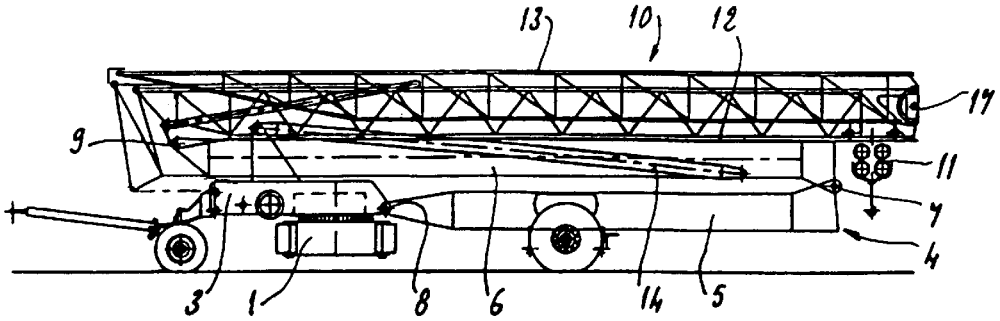
FIG. 2 depicts the same crane in a side view, but in the folded transport position.

FIGS. 1 to 3 show a folding tower crane which comprises a stationary base chassis 1 on which a revolving chassis 3, orientable about a vertical axis 2, is mounted. The crane comprises a mast 4, made of two elements 5 and 6 articulated together about a horizontal axle 7. The lower mast element 5 is articulated by its base about a horizontal axle 8, at the front of the revolving chassis 3. Articulated to the top of the upper mast element 6, about a horizontal axle 9, is a jib 10 along which a crab 11 can travel, the jib 10 in this instance being made up of two elements, namely a jib root 12 and a jib tip 13. As shown in FIG. 1, the crane also comprises stays 14 for holding the mast 4 upright, a device 15 for retaining the jib 10, and ballast 16 carried by the rear part of the revolving chassis 3.

The jib root 12 has a triangular cross section, and the jib tip 13 has a U-shaped cross section. This jib tip 13 is articulated, by its rear part, to the front part of the jib root 12, about a horizontal axle 17 located approximately mid-way up the jib 10. Thus, when the crane is in the folded position (see FIGS. 2 and 3), the two mast elements 5 and 6 are arranged horizontally one above the other, and the two jib elements 12 and 13 are also arranged horizontally, above the mast elements 5 and 6, these two jib elements 12 and 13 being nested one inside the other, the triangular cross section of the jib root 12 fitting into the U-shaped cross section of the inverted jib tip 13 (see also FIG. 8).

Figure 4:
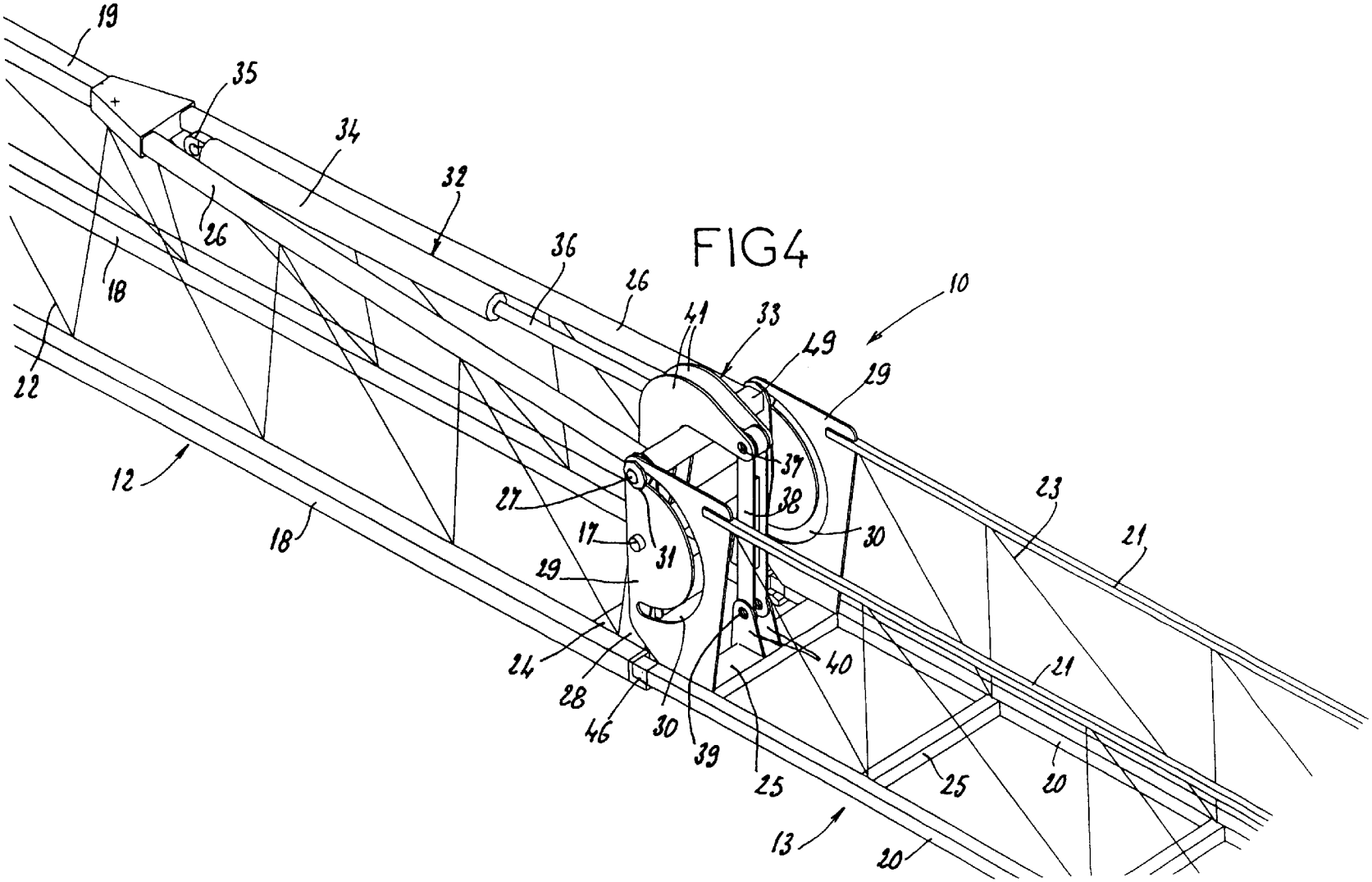
FIG. 4 is a partial perspective view of the aligned jib, more particularly showing the folding device.

In detail, as shown in FIG. 4 et seq, the jib root 12 comprises two lower members 18, acting as runway for the crab 11, and an upper member 19 defining the triangular main section of the jib root 12. The jib tip 13 comprises two lower members 20, and two upper members 21. The members are connected together, on the various faces of the two jib elements 12 and 13, by latticework structures 22, 23 and by lower cross members 24, 25.

In the front part of the jib root 12, the upper member 19 splits into two symmetric branches 26, the front ends of which are connected by a transverse stiffening sleeve 49 through which there passes a horizontal axle 27 which is located in the region of the upper members 21 of the jib tip 13. Two lateral plates 28 connect the ends of the sleeve 49 to the respective front ends of the two lower members 18 of the jib root 12.

In the rear part of the jib tip 13 there are two vertical lateral plates 29, each of which connects a lower member 20 to the upper member 21 that is located on that same side.

The horizontal axle 17 by means of which the jib tip 13 is articulated to the jib root, passes through the two lateral plates 28 and also through the two lateral plates 29, approximately mid-way up. This horizontal axle 17 has functional play, allowing it to free any loading to make the connecting system an isostatic one when the jib 10 is aligned.

Formed in each lateral plate 29 of the jib tip 13 is an articulation slot 30 in the shape of an arc of a circle, centered on the horizontal axle 17. The two arc-shaped slots 30 have, passing through them, the ends of the horizontal axle 27 located at the front of the jib root 12. This axle 27 is equipped at each end with a lateral immobilizing member 31 such as a head or a washer.

The aforementioned articulation is motorized by a dual-acting ram 32 and a system of link rods 33.

The ram 32, located in the vertical mid-plane of the jib 10, has a body 34 articulated by its rear end, about a horizontal axle 35, to the jib root 12 in the region the upper member 19, particularly at the point where this upper member 19 splits into two branches 26. The rod 36 of the ram 32 is articulated by its front end, about a horizontal axle 37, to one end of a first link rod 38 belonging to the system of link rods 33.

The link rod 38 is a straight double link rod, the lower end of which is articulated, about a horizontal axle 39, to a clevis mount 40 fixed on the lower rear cross member 25 of the jib tip 13.

The system of link rods 33 comprises another double link rod 41, of cranked shape. One end of the cranked double link rod 41 is articulated, about the aforementioned horizontal axle 37, to the front end of the rod 36 of the ram 32. The other end of the cranked double link rod 41 is articulated, about a horizontal axle 42, to a clevis mount 43 fixed on the lower front cross member 24 of the jib root 12.

Figure 5:
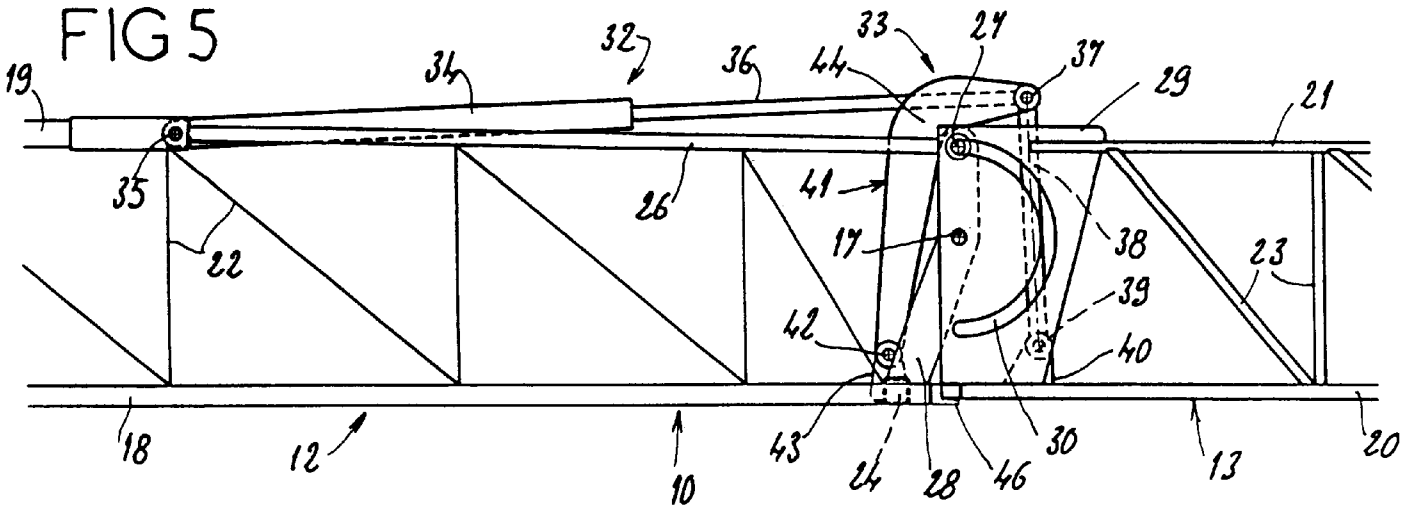
FIG. 5 is a partial side view of the aligned jib, in the region of its folding device.

The cranked region 44 of the double link rod 41 allows passage for the horizontal axle 27, as shown in particular in FIGS. 4 and 5. The double link rod configuration of this cranked link rod 41, and of the first link rod 38 allows free passage for the rod 36 of the ram 32.

Figure 6:
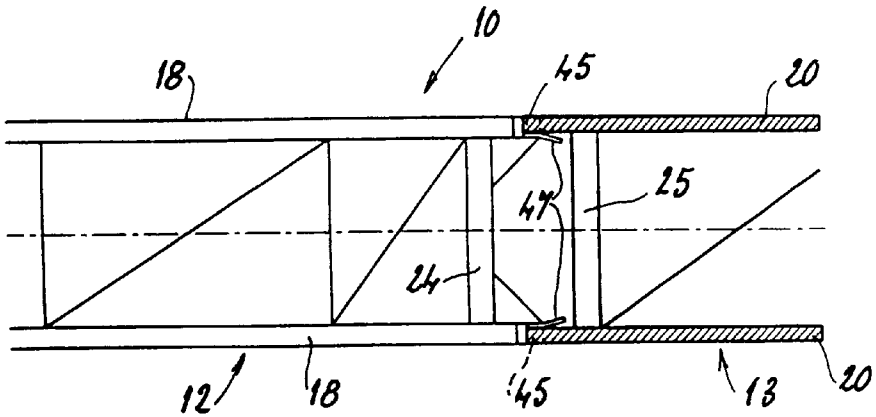
FIG. 6 is a partial view from above of the aligned jib, illustrating the supports for the lower members.

The entirely deployed position of the rod 36 of the ram 32 corresponds to the aligned position of the jib 10, illustrated in FIGS. 4, 5 and 6. In this position, the horizontal axle 27 is in abutment at one end of the arc-shaped slots 30, which provides linkage and continuity of the respective upper members 19, 26 and 21 of the jib root 12 and of the jib tip 13.

Furthermore, when the jib 10 is in this aligned position as shown more particularly in FIGS. 5 and 6, there is a guided link between the respective lower members 18 and 20 of the jib root 12 and of the jib tip 13. This guided connection is achieved through:

horizontal support 45 due to the force of gravity applied to the jib tip 13 articulated about the horizontal axle 27;

lower guidance afforded, on each side of the jib 10, by a support plate 46 welded to the front end of the lower member 18 of the jib root 12 and intended to absorb vertical loading;

lateral guidance afforded, on each side, by a ramped support plate 47 intended to ease the alignment of the lower members 18 and 20 and absorb the transverse horizontal loadings.

Figure 7:
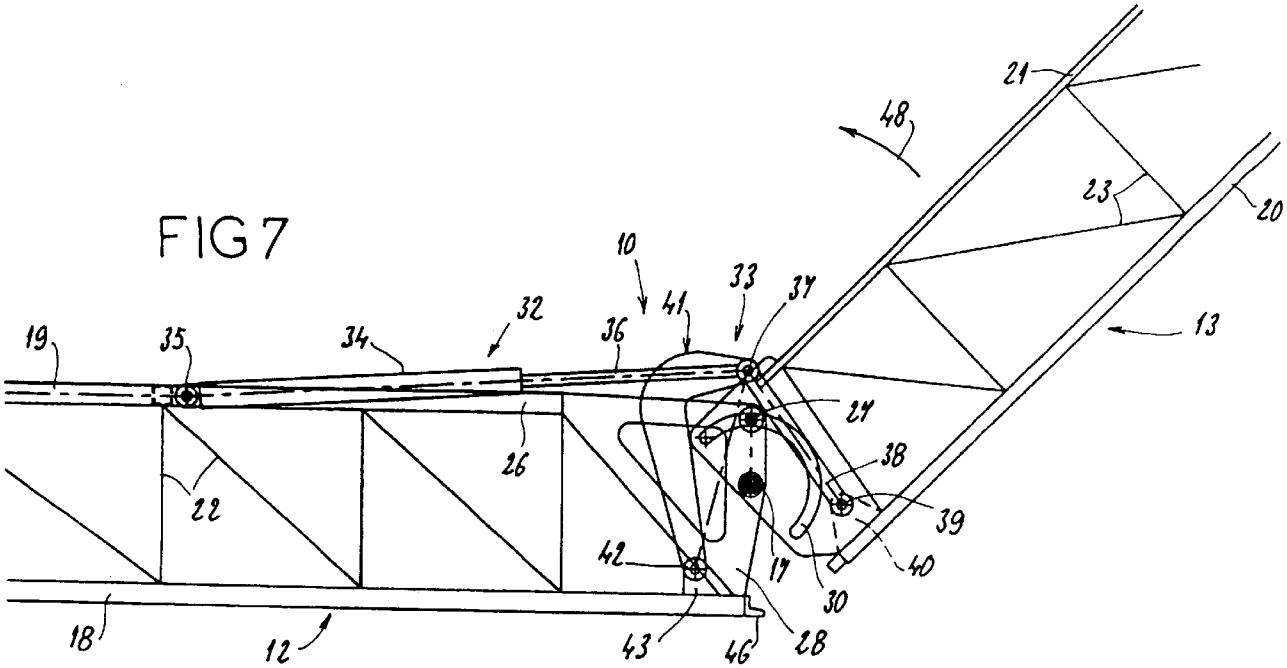
FIG. 7 is another partial side view of the jib, while it is in the process of being unfolded or folded.

Starting out from the aforementioned aligned position, the jib 10 can be folded by operating the ram 32 in such a way as to retract its rod 36. With the jib root 12 kept approximately horizontal, the jib tip 13 pivots about the horizontal axle 17 and lifts up in the direction of arrow 48, passing through intermediate positions one of which is illustrated in FIG. 7.

Figure 8:
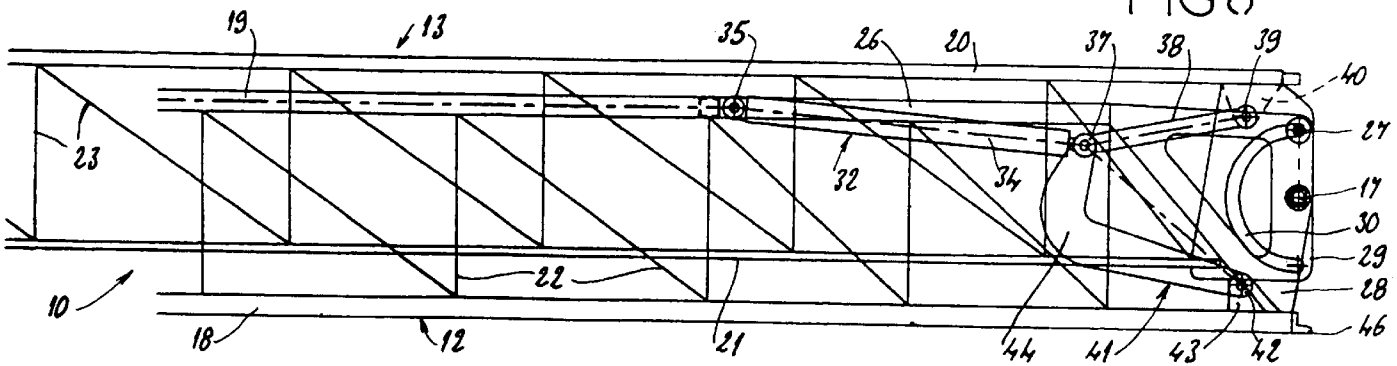
FIG. 8 is another partial side view of the jib, fully folded.

As the movement thus brought about by the ram 32 continues, the jib tip 13 is folded down onto the jib root 12 until, having pivoted through 180° , it nests in this jib root 12, FIG. 8 showing the fully folded position of the jib 10. In this position, the axle 27 comes into abutment against the other end of the arc-shaped slots 30.

Operating the ram 32 in the opposite direction, that is to say in the direction of deploying its rod 35, brings about the reverse movement, namely that of unfolding the jib 10, bringing the jib tip 13 into alignment with the jib root 12.

It would not be departing from the scope of the invention as defined in the appended claims if:

as the opposite to the example described, one were to envisage a jib root with a U-shaped cross section and a jib tip of triangular cross section, or jib elements of any other nesting shape;

the same folding device were to be applied to a crane jib made of more than two articulated elements, for example a jib made of three elements, in which case the device would be nted between an intermediate jib element and the jib tip, which could be nested with the intermediate element.

What is claimed is:

1. A device for the motorized folding and unfolding of a crane jib made up of elements joined together by articulation, with two consecutive jib elements, the two consecutive jib elements being a rear jib element and a front jib element which can nest one inside the other when the jib is in a folded position, the two consecutive jib elements having respective cross sections which allow them to nest, the front jib element and the rear jib element being articulated together about a first horizontal axle located approximately mid-way up the jib, the front jib element having, in its rear part, lateral guides shaped as arcs of a circle, the lateral guides housing a second horizontal axle connected to the rear jib element, the device comprising:

a double-acting ram located in the vertical mid-plane of the crane jib and articulated by a first end, about a third horizontal axle, to the rear jib element in an upper member or members of the rear jib element;

a first link rod articulated, by a first end, to a second end of the double-acting ram and articulated, by a second end, to the rear part of the front jib element in the lower part of the front jib element; and a second link rod articulated, by a first end, to the second end of the double-acting ram and articulated, by a second end, to the front part of the rear jib element in the lower part of the rear jib element, the second link rod leaving space for the passage of the second horizontal axle housed in the lateral guides.

2. The device as claimed in claim 1, wherein the straight first link rod and the cranked second link rod are both double link rods leaving space for the unimpeded passage of the double acting ram.

3. The device as claimed in claim 1, wherein the second end of the first link rod is articulated to a first clevis mount fixed to the lower part of the front jib element and the second end of the second link rod is articulated to a second clevis mount fixed to the lower part of the rear jib element.

4. The device as claimed in claim 1, wherein the rear part of the front jib element comprises two vertical lateral plates, in each of which is one of the lateral guides with the second horizontal axle passing through each of the lateral plates and also having, passing through it, the first axle that articulates the front jib element with respect to the rear jib element and which is located approximately mid-way up the jib.

5. The device as claimed in claim 1, wherein the first axle that articulates the front jib element with respect to the rear jib element and which is located approximately mid-way up the jib, has functional play.

6. The device as claimed in claim 1, wherein the front ends of the upper members of the rear jib element are connected by a transverse stiffening sleeve through which the second horizontal axle passes.

7. The device as claimed in claim 1, wherein the lower members of the rear jib element comprise, at their front end, support and guiding means for the rear ends of the lower members of the front jib element, said mean comprising, at the front end of each lower member of the rear jib element, a horizontal support and a lower guide afforded by a support plate, and a lateral guide afforded by a ramped support plate.

8. The device as claimed in claim 1, wherein, the rear jib element is a jib root and the front jib element is a jib tip.

* * * * *